US007143607B2

(12) United States Patent
Hartgrove

(10) Patent No.: US 7,143,607 B2
(45) Date of Patent: Dec. 5, 2006

(54) JEWELRY ARTICLE HAVING INTERCHANGEABLE SETTING AND CAPTURE MODULE

(75) Inventor: Ronald W Hartgrove, Houston, TX (US)

(73) Assignee: Heart & Company, Houston, TX (US)

( * ) Notice: Subject to any disclaimer, the term of this patent is extended or adjusted under 35 U.S.C. 154(b) by 100 days.

(21) Appl. No.: 10/649,309

(22) Filed: Aug. 27, 2003

(65) Prior Publication Data

US 2005/0044891 A1 Mar. 3, 2005

(51) Int. Cl.
*A44C 9/00* (2006.01)
*A44C 17/02* (2006.01)

(52) U.S. Cl. ..... 63/29.1; 63/15; 63/40

(58) Field of Classification Search ..... 63/15, 63/26, 29.1, 29.2, 30, 31, 40, 900
See application file for complete search history.

(56) References Cited

U.S. PATENT DOCUMENTS

| | | | | |
|---|---|---|---|---|
| 0,899,296 | A | 9/1908 | Elliot | 63/29.1 |
| 1,182,534 | A | 5/1916 | Drigott | 63/29.1 |
| 1,707,780 | A * | 4/1929 | Bond | 63/29.1 |
| 1,712,171 | A | 5/1929 | Rochas | 63/29.1 |
| 1,951,706 | A * | 3/1934 | Powers | 63/26 |
| 3,115,758 | A | 12/1963 | Eberle et al. | 63/15 |
| 3,192,737 | A | 7/1965 | Schechter et al. | 63/1 |
| 3,307,375 | A | 3/1967 | Estrin et al. | 63/15 |
| 3,399,547 | A | 9/1968 | Spielman et al. | 63/15 |
| 3,543,535 | A | 12/1970 | Siegel et al. | 63/29.1 |
| 3,568,467 | A | 3/1971 | Ellison | 63/29.1 |
| 3,639,949 | A | 2/1972 | Beck | 24/66.11 |
| 4,052,864 | A | 10/1977 | Haffsaess | 63/31 |
| 4,059,971 | A | 11/1977 | Shoji | 63/14 R |
| 4,186,567 | A | 2/1980 | Monden et al. | 63/14 R |
| 4,195,492 | A | 4/1980 | Johnson | 63/12 |
| 4,374,470 | A | 2/1983 | Isaacson | 63/29.1 |
| 4,393,667 | A | 7/1983 | Reinstein et al. | 63/29 |
| 4,416,074 | A | 11/1983 | Guerrero et al. | 40/364 |
| 4,424,689 | A | 1/1984 | Saito | 63/15.1 |
| 4,783,974 | A | 11/1988 | Hernandez | 63/1.16 |
| 4,785,981 | A | 11/1988 | Rodman | 63/19 |
| 4,905,482 | A * | 3/1990 | Gheblikian | 63/29.1 |
| 4,912,944 | A | 4/1990 | Crosley et al. | 63/29.2 |
| 4,982,581 | A | 1/1991 | Furuyama | 63/29.1 |
| 5,036,681 | A | 8/1991 | Schaerer | 63/14.5 |
| 5,133,195 | A | 7/1992 | Appelbaum et al. | 63/29.1 |
| 5,193,360 | A | 3/1993 | Lovegrove | 63/15 |
| 5,228,317 | A | 7/1993 | Hendricks | 63/15.7 |
| 5,283,966 | A | 2/1994 | Rader et al. | 63/20 |
| 5,353,608 | A | 10/1994 | Berkowitz | 63/1.1 |
| 5,357,770 | A | 10/1994 | Lanyi | 63/29.1 |
| 5,375,434 | A | 12/1994 | Werthiemer et al. | 63/29.1 |
| 5,491,986 | A * | 2/1996 | White | 63/29.1 |

(Continued)

*Primary Examiner*—Jack W. Lavinder
(74) *Attorney, Agent, or Firm*—Howrey LLP

(57) ABSTRACT

A jewelry article includes an interchangeable setting, a shank or body, and a capture module. The shank defines a mounting area that holds the setting on the shank except substantially along one axis when the setting is positioned in the mounting area. The capture module couples on the shank. For example, the module can include a slot fitting on a portion of the shank. When the module is coupled on the shank, the module prevents removal of the setting from the mounting area substantially along the one axis. When worn by a wearer, the finger of the wearer, for example, maintains the module coupled to the shank so that the setting is captured on the jewelry article.

24 Claims, 5 Drawing Sheets

U.S. PATENT DOCUMENTS

| | | | | |
|---|---|---|---|---|
| RE35,511 | E | 5/1997 | Nakamura | 63/12 |
| 5,636,531 | A | 6/1997 | Miller | 63/15.6 |
| 5,682,648 | A | 11/1997 | Miller | 24/5 |
| 5,682,769 | A | 11/1997 | Baker | 63/29.1 |
| 5,685,174 | A | 11/1997 | Balzer et al. | 63/29.1 |
| 5,722,260 | A | 3/1998 | Mangano | 63/3.1 |
| 5,806,346 | A | 9/1998 | Schlinger et al. | 63/40 |
| 5,974,634 | A | 11/1999 | Eisenpresser | 63/29.1 |
| 6,003,334 | A | 12/1999 | Miller | 63/15.5 |
| 6,101,843 | A | 8/2000 | Nagano | 63/15.4 |
| 6,131,408 | A | 10/2000 | Gill | 63/15.8 |
| 6,145,341 | A | 11/2000 | Leong | 63/1.11 |
| 6,305,192 | B1 | 10/2001 | Indiveri et al. | 63/12 |
| 6,470,708 | B1 | 10/2002 | Green | 63/3.2 |
| 6,484,537 | B1 | 11/2002 | Takessian | 63/29.1 |
| 6,490,886 | B1 | 12/2002 | Steinhauer et al. | 63/15 |
| 6,594,871 | B1 | 7/2003 | Hoffman | 24/303 |
| 6,715,315 | B1 * | 4/2004 | Hartgrove | 63/29.2 |
| 2001/0017041 | A1 | 8/2001 | Tseng | 63/1.11 |
| 2001/0052245 | A1 | 12/2001 | Lovegrove | 63/15 |
| 2002/0073732 | A1 | 6/2002 | Masina et al. | 63/1.11 |
| 2002/0139142 | A1 | 10/2002 | Marandola | 63/22 |

* cited by examiner

JEWELRY ARTICLE HAVING INTERCHANGEABLE SETTING AND CAPTURE MODULE

FIELD OF THE INVENTION

The present invention relates generally to a jewelry article, and more particularly to a jewelry article having an interchangeable setting and capture module.

BACKGROUND OF THE INVENTION

The desirability of having jewelry articles, such as rings, earrings, and bracelets, with interchangeable settings has long been evident in the art. In U.S. patent application Ser. No. 09/982,662, entitled "Decorative Articles with Interchangeable Settings," which is incorporated herein by reference in its entirety, I disclose interchangeable modules, which attach to decorative articles using mechanical structures. In co-pending U.S. patent application Ser. No. 10/252,316, entitled "Jewelry Articles Having Magnetic Elements and Interchangeable Settings," which is incorporated herein by reference in its entirety, I disclose jewelry articles having magnetic elements and interchangeable settings. Being interchangeable, the setting can be matched to other articles of jewelry, clothing, or accessories.

Jewelry articles having removable settings are known in the art. For example, U.S. Pat. Nos. 1,712,171; 1,182,534; 3,543,535; 3,568,467; 4,374,470; 4,393,667; 4,905,482; 4,982,581; 5,133,195; 5,193,360; 5,228,317; 5,357,770; 5,375,434; 5,682,769; 6,131,408; 6,490,886 and 6,484,537 and U.S. Patent Application No. 2001/0052245 disclose articles of jewelry that have removable settings. Even though these prior art patents and publication disclose several techniques for providing removable settings, jewelry designers are constantly trying to enhance their designs. In the present disclosure, jewelry articles having interchangeable settings and capture modules are disclosed, which increase the versatility and aesthetic value of the jewelry articles.

SUMMARY OF THE INVENTION

Jewelry articles are disclosed that include a setting, a shank or body, and a capture module. The shank defines a mounting area that holds the setting on the shank except substantially along one axis when the setting is positioned in the mounting area. The capture module couples on the shank. For example, the module can include a slot fitting on a portion of the shank. When the module is coupled on the shank, the module prevents removal of the setting from the mounting area substantially along the one axis. When worn, the finger of the wearer, for example, can maintain the module coupled to the shank so that the setting is not capable of escaping. The shank can define a recessed portion for coupling with a portion of the module. The module can define a slot for coupling with the shank. The module, like the setting, can be interchangeable. To prevent removal of the setting from the mounting area substantially along the one axis, the module can have first and second portions positioning at least partially adjacent the mounting area of the shank. In one embodiment, the setting is substantially spherical, and the mounting area is defined by a radius and has a circumferential dimension at least greater than half of a circle.

The foregoing summary is not intended to summarize each potential embodiment or every aspect of the present disclosure.

BRIEF DESCRIPTION OF THE DRAWINGS

The foregoing summary, preferred embodiments, and other aspects of the subject matter of the present disclosure will be best understood with reference to a detailed description, which follows, when read in conjunction with the accompanying drawings, in which.

Figure 1:
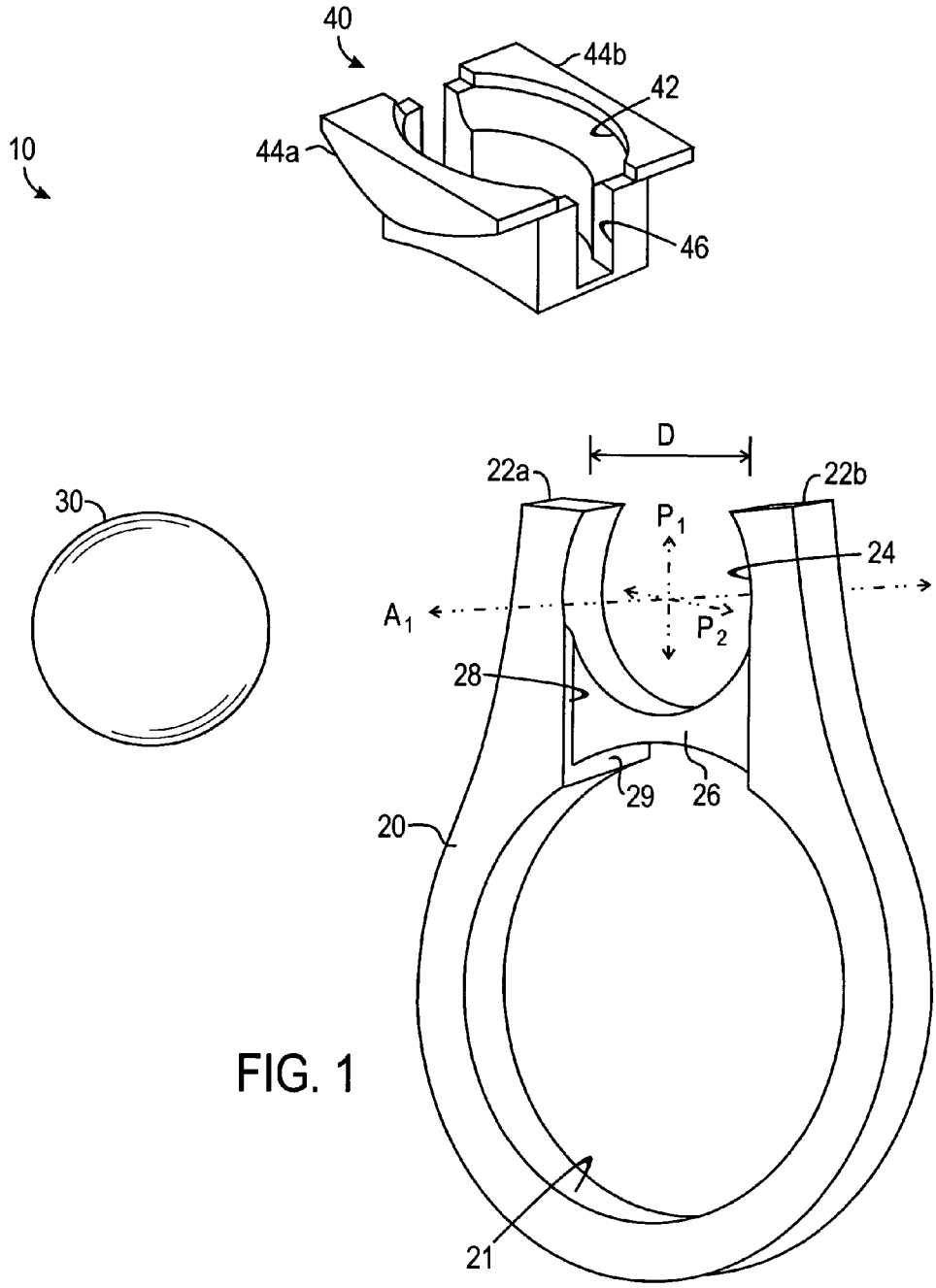
FIG. 1 illustrates a first embodiment of a jewelry article having an interchangeable setting and capture module in an unassembled state.

While the disclosed jewelry article having interchangeable setting and capture module is susceptible to various modifications and alternative forms, specific embodiments thereof have been shown by way of example in the drawings and are herein described in detail. The figures and written description are not intended to limit the scope of the inventive concepts in any manner. Rather, the figures and written description are provided to illustrate the inventive concepts to any person skilled in the art by reference to particular embodiments, as required by 35 U.S.C. § 112.

DETAILED DESCRIPTION OF THE INVENTION

Figure 2C:
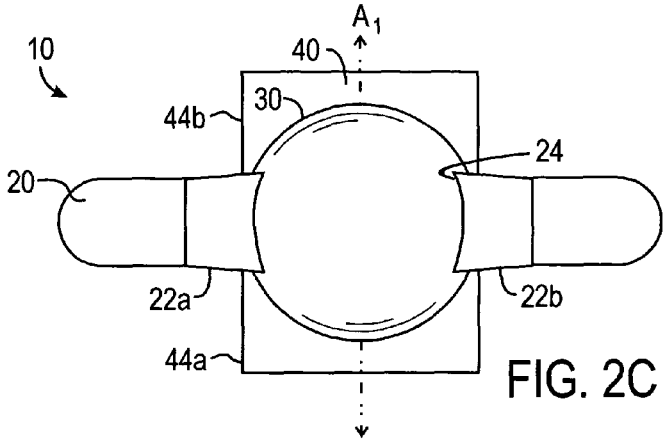
FIGS. 2A–2C illustrate various views of the jewelry article of FIG. 1 when assembled.
Figure 2A:
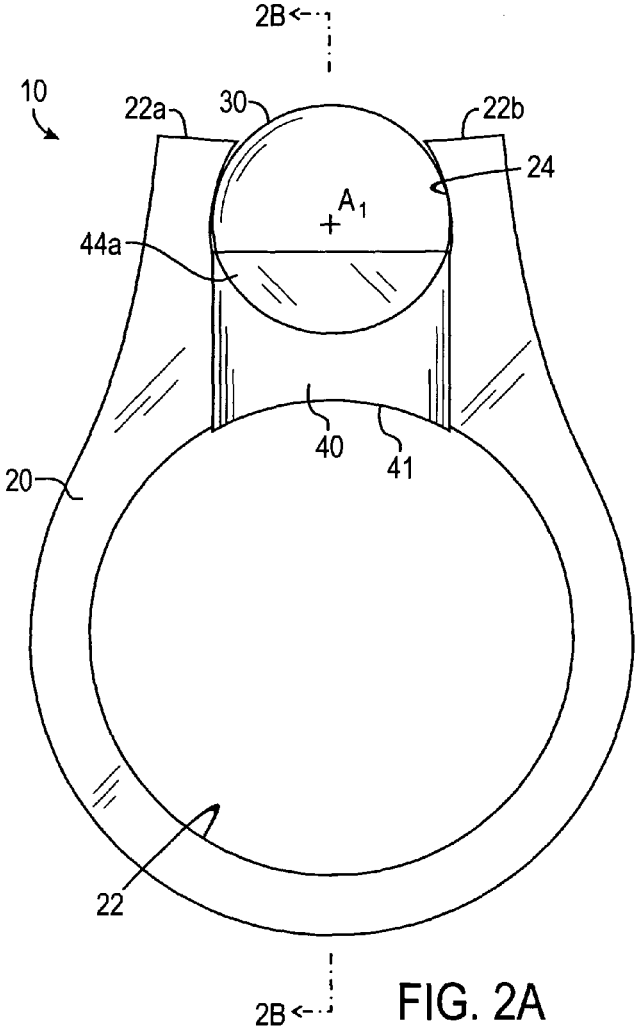
Figure 2B:
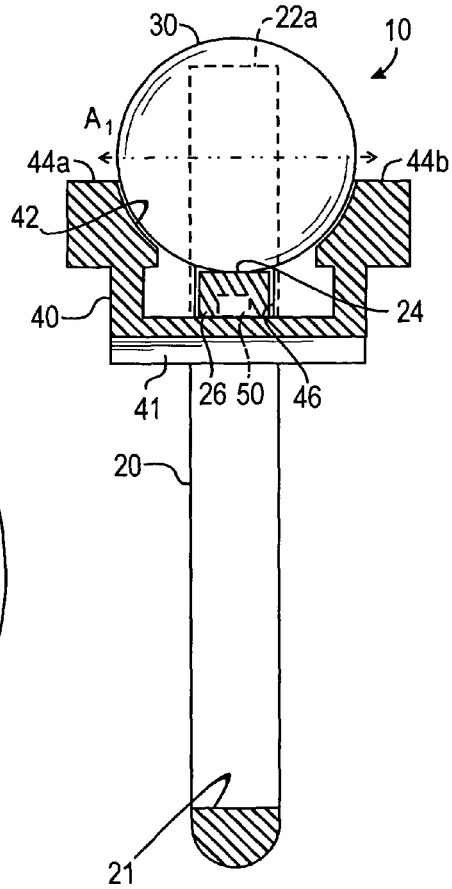

Referring to FIGS. 1 and 2A–2B, an embodiment of a jewelry article 10 is illustrated in various views. In FIG. 1, the jewelry article 10 is shown in an unassembled state. The jewelry article 10 includes a body or shank 20, a setting 30, and a capture module 40. In FIGS. 2A–2C, the shank 20, setting 30, and module 40 of the jewelry article 10 of FIG. 1 are shown in an assembled state from front, side cross-section, and top views, respectively. In this and other embodiments disclosed herein, of the jewelry articles including the shanks, interchangeable settings, and capture modules, are depicted in a basic form to show their gross anatomy. It is understood that these basic forms can be aesthetically designed or altered without departing from the present disclosure.

In the present embodiment, the shank 20 is formed as a ring to be worn on a finger (not shown) and has a finger opening 21. However, it will be appreciated that the body or shank 20 according to the teachings of the present disclosure can have the form of another jewelry article, such as an earring or bracelet, to be worn by a wearer. For example, the shank 20 and opening 21 may be sized to fit on the wrist or other body portion of a wearer. The shank 20 can be composed of a suitable material, such as a precious metal, and can be formed by methods known in the art, such as machining, casting, soldering, or a combination thereof.

The shank 20 defines a mounting area 24 for receiving the interchangeable setting 30. The mounting area 24 is formed such that the setting 30 can only be inserted into the mounting area 24 substantially along one axis $A_1$. In the present embodiment, the one axis $A_1$ is approximately perpendicular to the front and back surfaces of the shank 20. When the setting 30 is positioned in the mounting area 24 as shown in FIGS. 2A–2C, the mounting area 24 is capable of holding the setting 30 on the shank 20 except substantially along this one axis $A_1$. Due to differences in tolerance, it is understood that the setting 30 may be able to move slightly within the mounting area 24 when positioned therein. Yet, the setting 30 is substantially prevented from removal or escape from the mounting area along any axes orthogonal to the one axis $A_1$, such as axes $P_1$ and $P_2$ shown in FIG. 1.

In the present embodiment of FIGS. 1 and 2A–2B, the interchangeable setting 30 is substantially spherical so that the mounting area 24 preferably defines a radial surface. The mounting area 24 in the present embodiment defines an at least partially radial surface having a diameter D approximately equal to that of the setting 30. To positively hold the setting 30 except along the one axis $A_1$, a circumferential dimension defined by the at least partially radial surface of the mounting area 24 is at least greater than half of a circle. In this way, an open portion of the mounting area 24—where ends of the prongs 22*a*, 22*b* are separated from one another—is less than the diameter D of the mounting area 24. Adjacent the mounting area 24, the shank 20 has two mounting sides or prongs 22*a*, 22*b* and a bridge 26. In the present embodiment, the prongs 22*a*, 22*b* do not fully enclose the mounting area 24. This is not strictly necessary, as the prongs 22*a* and 22*b* may be connected together to fully enclose the mounting area 24 such that the area 24 defines a hole through the shank 20.

Although the setting 30 in the present embodiment is substantially spherical, the setting 30 can include at least a portion that positions within the mounting area 24 and that is defined by a portion of a sphere, disc, cylinder or other radial shape. Furthermore, it will be appreciated that a setting for a jewelry article of the present disclosure can have any desirable shape, and a mounting area of the present disclosure for such a setting, therefore, can have any complimentary shape. For example, as will be evident herein, a setting of the present disclosure can include at least a portion having any particular shape that positions within a substantially complementary mounting area such that the setting is held in the area except substantially along the one axis $A_1$.

The capture module 40 has an end 42, sides 44*a*, 44*b*, and a bridge slot 46. As best shown in FIG. 2A, the end 42 of the module 40 is preferably contoured to substantially complete the contour of the finger opening 21 when the module 40 is coupled on the shank 20. As best shown in FIG. 1, the sides 44*a*, 44*b* define a capture area 42, which is radial for the spherical setting 30 of the present embodiment. The bridge slot 46 passes along the length of the module 40 between the sides 44*a*, 44*b*.

The bridge 26 of the shank 20 is positioned between the mounting area 24 and the opening 21 for wearing the article. To hold the setting 30 in the mounting area 24 of the shank 20, the capture module 40 mechanically couples on the shank 20 by fitting onto the bridge 26 from the direction of the finger opening 21. In particular, the bridge slot 46 of the module 40 fits onto the bridge 26 from the direction of the opening 21 for wearing the article. The bridge 26 is preferably recessed so that guide slots 28 are formed on both sides of the shank 20 and an opening recess 29 is formed at the finger opening 21 of the shank 20. The guide slots 28 and opening recess 29 on the bridge 26 facilitate the fit of the capture module 40 on the bridge 26.

As best shown in FIGS. 2A–2C, the setting 30 is positioned in the mounting area 24 of the shank 30, and the capture module 30 is coupled onto the shank 20 from the finger opening 21 by fitting the bridge slot 46 of the module 40 onto the bridge 26 of the shank 26. Once positioned on the bridge 26, the portions or sides 44*a*, 44*b* of the module 40 at least partially position adjacent portions or sides of the setting 30, thereby preventing the removal of the setting 30 from the mounting area 24 substantially along the one axis $A_1$. When the assembled jewelry article 10 is then worn, the finger (not shown) of the wearer in the opening 21 of the shank 20 prevents the module 40 from moving away from the setting 30. Consequently, the setting 30 remains captured on the jewelry article 10 because it is prevented from escaping the mounting area 24 from any direction.

In one embodiment, one or both of the capture module 40 and the shank 20 can include a magnet to further provide magnetic coupling between the module 40 and shank 20. As shown in FIG. 2B, a magnet 50, such as a rare earth-neodymium magnet, can be positioned on the bridge 26 to magnetically connect with permeable material of the module 40 or another magnet (not shown) on the module. The magnet 50 can at least temporarily hold the capture module 40 on the shank 20 once they are assembled. Although use of the magnet 50 is not strictly necessary to sufficiently hold the setting 30 on the jewelry article 10 when worn, use of the magnet 50 may help a wearer put on and remove the article 10 or may facilitate storage of the article 10 and setting 30 when not being worn, for example.

Because the jewelry article 10 includes multiple components, one or more of the shank 20, setting 30, and module 40 can be interchanged with another such component having a different design or aesthetic quality. When the capture module 40 and shank 20 are uncoupled, for example, a new setting (not shown) having a different shape or aesthetic quality can be interchangeably positioned in the mounting area 24. In addition, because the capture module 40 is removable, a new capture module (not shown) having a different shape or aesthetic quality, such as stones, inlays, or embossed surfaces, can be interchangeably coupled with the shank 20. Therefore, a wearer can form numerous combinations of interchangeable shanks 20, settings 30, and modules 40 to create jewelry articles with different aesthetic characteristics. Because the setting 30 and module 40 are interchangeable, the aesthetic value of the jewelry article 10 is enhanced. In addition, the setting 30 and module 40 are each substantially symmetrical bodies, and they couple together so that the fact that they are interchangeable can be sufficiently disguised. Moreover, the module 40 need not fully encompass the setting 30 so that most of the setting 30 can be visible when held on the article 10, which can also enhance the aesthetic value of the jewelry article 10.

Figure 3B:
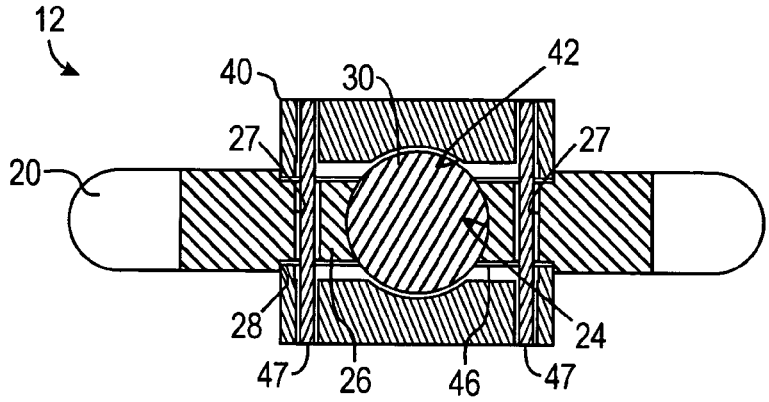
FIGS. 3A–B illustrates various view of a second embodiment of a jewelry article having an interchangeable setting and capture module.
Figure 3A:
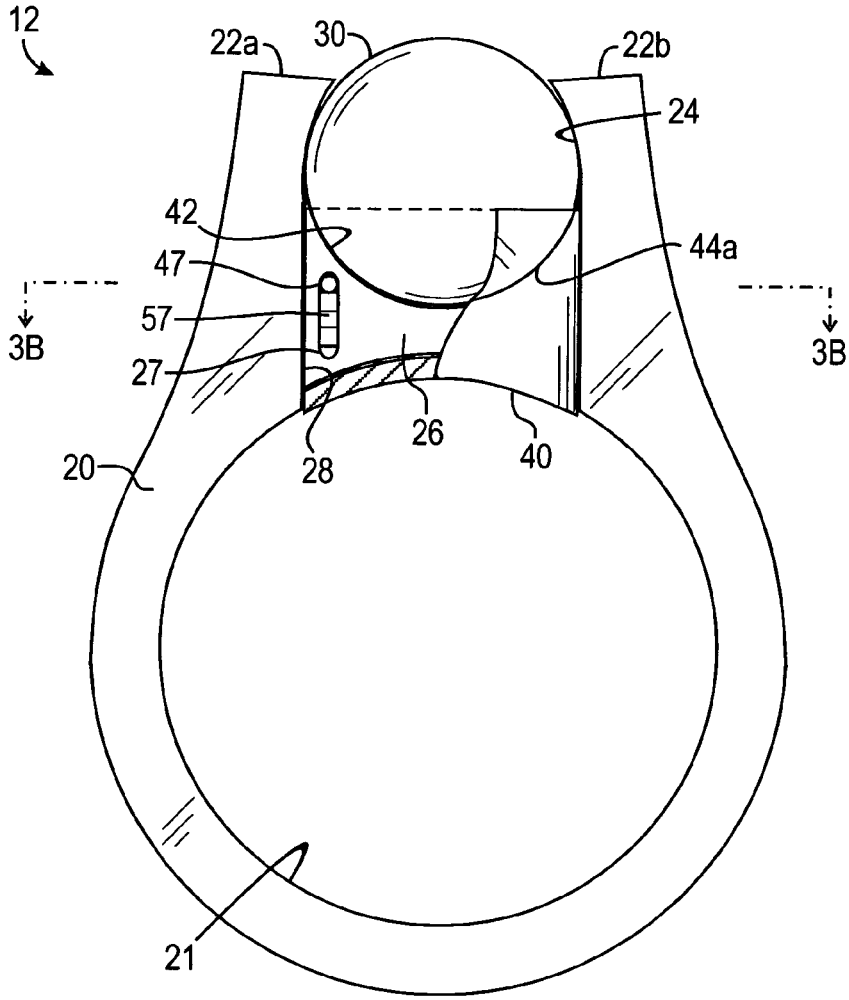

Referring to FIGS. 3A–3B, a second embodiment of a jewelry article 12 is illustrated in a side view. Aspects of the jewelry article 12 are substantially similar to those disclosed in FIGS. 1 and 2A–2B so that the same reference numbers indicate like features. For illustrative purposes, one side 44*a* of the module 40 is shown partially cutaway to reveal addition details in FIG. 3A. In the present embodiment, the bridge 26 defines an elongated slot 27 through which a cross member 47 pass. Another slot and cross member arrangement (shown in the top cross section of FIG. 3B) may be provided. The cross member 47 can be a metal pin. During assembly, the cross member 47 is passed into one hole (not shown) in one side of the capture member 40, passed through the elongated slot 27 in the bridge 26, and passed into another hole (not shown) on the other side of the capture member 40. The ends of the cross member 27 are then welded into the holes in the sides of the capture module 40, for example, and the outer surface of the module 40 is polished.

In the present embodiment, the capture module 40 is fixedly held on the shank 20 but is movable up and down to capture and release the interchangeable setting 30 positioned in the mounting area 24. Thus, the module 40 is not interchangeable in the present embodiment, unless the pin 27 is configured for removal from the slot 47. For example, instead of soldering ends of the pin 27 to the sides of the module 40, the ends could be threaded or held by removable fasteners (not shown). It will be appreciated that other combinations of slots and pins than those depicted in FIGS. 3A–3B can be used to fixedly hold the capture module 40 on the shank 20 yet allow the module 40 to move relative to the mounting area 24. In another example, the shank 20 may define grooves or slots, and the capture module 40 may be formed from two halves having inwardly projection tabs (not shown) formed on inner surfaces. The halves of the capture module 40 can be positioned on either side of the shank 20 so that the tabs fit into the grooves in the shank 20. The halves of the capture module 40 can then attached together so that the module 40 is held on the shank 20 by the tabs in the grooves.

In a further aspect of the present embodiment of FIGS. 3A–3B, a biasing member 57 can be positioned in the elongated slot 27. Due to the small dimensions of a ring, for example, the biasing member 57 is preferably a leaf spring that may be soldered in position in the slot 27. The leaf spring 57 can engage the cross member 47 and can bias the capture module 40 to a position to capture the setting 30. Although use of the leaf spring 57 is not strictly necessary, use of the leaf spring 57 may help a wearer put on and remove the article 10 or may facilitate storage of the article 10 and setting 30 when not being worn, for example.

Figure 4C:
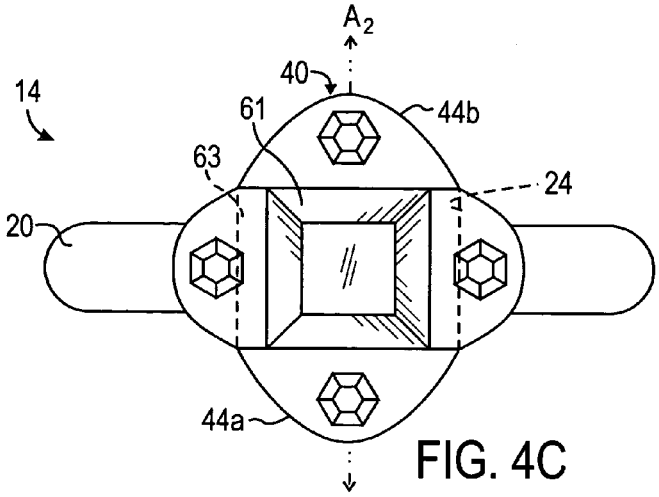
FIGS. 4A–4D illustrate side and top views of a third embodiment of a jewelry article having an interchangeable setting and capture module in an assembled state.
Figure 4D:
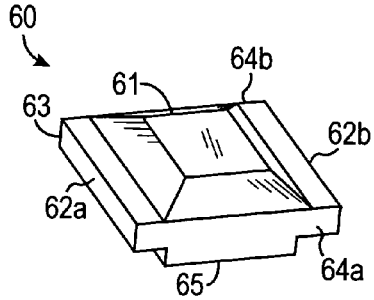
Figure 4A:
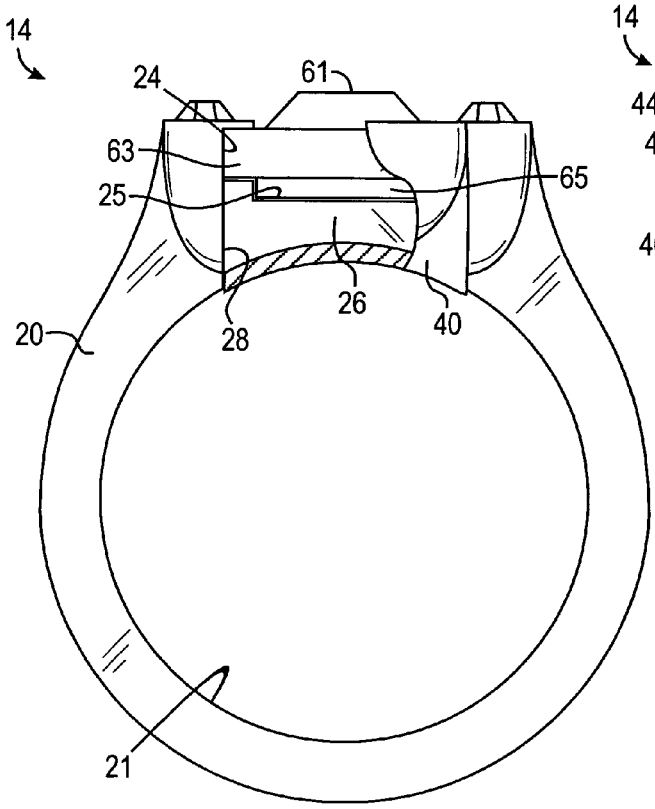
Figure 4B:
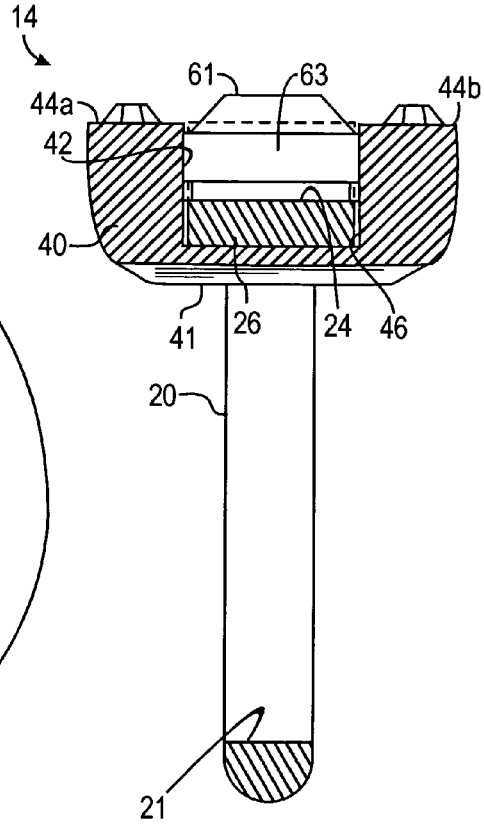

Referring to FIGS. 4A–4D, a third embodiment of a jewelry article 14 having an interchangeable setting 60 and a capture module 40 is illustrated in an assembled state. A side view of the jewelry article 14 is shown in FIG. 4A with one side 44*a* of the capture module 40 partially cutaway to reveal additional details for illustrative purposes. FIG. 4B shows a side cross-sectional view of the jewelry article 14, and FIG. 4C shows a top view of the jewelry article 14. Aspects of the jewelry article 14 of FIGS. 4A–4C are substantially similar to those disclosed in FIGS. 1 and 2A–2B so that the same reference numbers indicate like features.

In contrast to previous embodiments, the setting 60, which is shown in a perspective view of FIG. 4D, is not spherical. In general, the setting 60 can be a plate or other substantially flat member, for example. In the present embodiment, the setting 60 includes a decorative portion 61 and a mounting portion 63. The decorative portion 61 can be a stone or the like that is attached to the mounting portion 63 and extends above the mounting area 24 when positioned on the shank 20. The mounting portion 34 can be a substantially flat rectangle, as shown in FIGS. 4C and 4D, or can have any other shape. The mounting portion 63 may include a toe 65 that fits in a recess 25 of the mounting area 24 to facilitate positioning of the setting 60 in the mounting area 24 of the shank 20.

With the capture module 40 removed, the interchangeable setting 60 is positioned within the mounting area 24 substantially along one axis $A_2$, shown in FIG. 4C. The sides 22*a*, 22*b* of the shank 20 hold sides 62*a*, 62*b* of the setting 60 substantially along axes orthogonal to the one axis $A_2$. The capture module 40 is then fit onto the bridge 26 of the shank 20 by inserting the slot 46 in the module 40 onto the bridge 26 of the shank 20 from the direction of the finger opening 21. When fit onto the bridge 26, the sides 44*a*, 44*b* of the module 40 hold the sides 64*a*, 64*b* of the setting 60 in the mounting area 24 substantially along the one axis $A_2$. When the article 14 is worn, the finger of the wearer in the opening 21 of the shank 20 prevents the sides 44*a*, 44*b* of the module 40 from moving away from the setting 60. Consequently, the setting 60 is prevented from escaping the mounting area 24 from any direction. Because the setting 60 and module 40 are interchangeable, the aesthetic value of the jewelry article 14 is enhanced. In addition, the setting 60 and module 40 are symmetrical and couple together so that the fact that they are interchangeable can be sufficiently disguised.

Figure 5B:
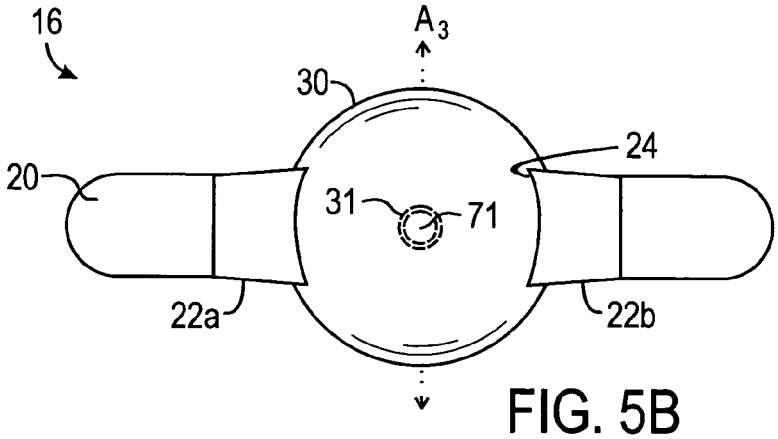
FIGS. 5A–5B illustrate side and top views of a fourth embodiment of a jewelry article having an interchangeable setting and capture module in an assembled state.
Figure 5A:
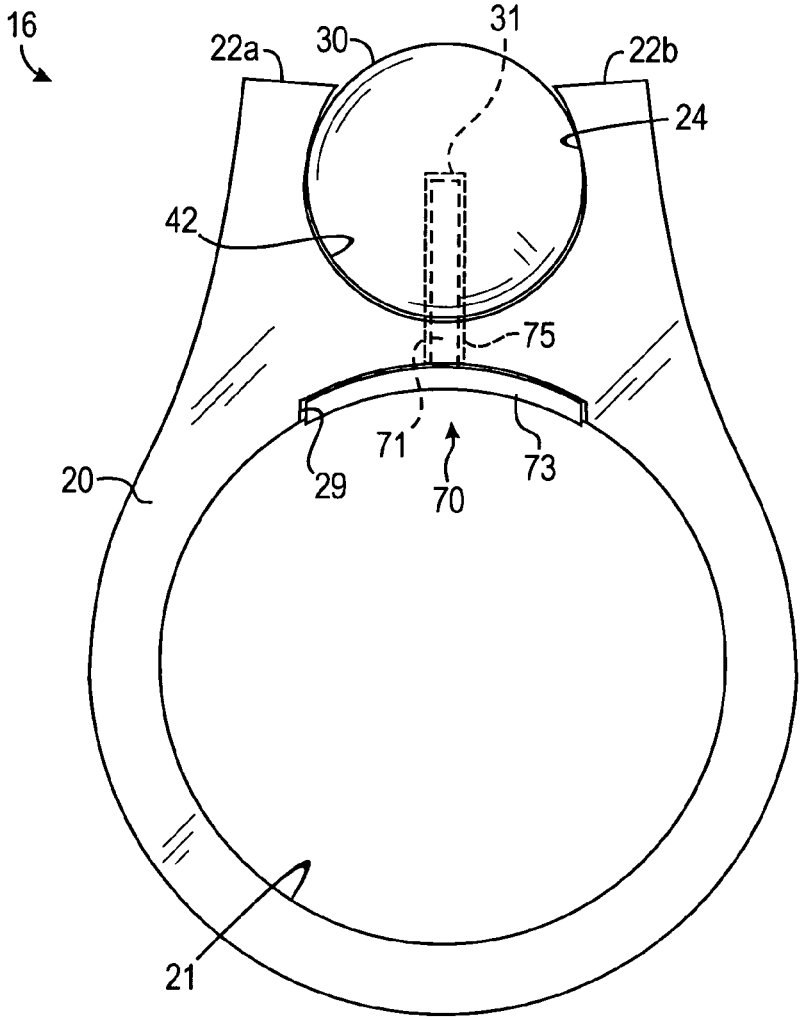

Referring to FIGS. 5A–5B, another embodiment of a jewelry article 16 having an interchangeable setting 30 and a capture module 60 is illustrated in an assembled state. Aspects of the jewelry article 16 of FIGS. 5A–5B are substantially similar to those disclosed in FIGS. 1 and 2A–2B so that the same reference numbers indicate like features. The interchangeable setting 30 in the present embodiment defines a bore 31. Although the setting 30 is spherical, it can have any desired shape. The capture module 70 includes an arm 71 attached to a body 73.

With the setting 30 and capture module 70 removed from the shank 20, the interchangeable setting 30 is positioned within the mounting area 24 substantially along one axis $A_3$. The sides 22*a*, 22*b* of the shank 20 hold the setting 40 substantially along axes orthogonal to the one axis $A_1$. The arm 71 of the capture module 70 is inserted through a slot or hole 75 in the shank 20 and inserted into the bore 31 of the setting 30. The body 73 of the module 70 then positions adjacent the opening 21 of the shank 21. When fit into the bore 31, the arm 71 of the module 70 holds the setting 40 in the mounting area 24 substantially along the one axis $A_3$.

Preferably, the body 73 of the module 70 is contoured like the opening 21 and is fit within a recess 29 defined in the opening 21. When the article 16 is worn, the finger of the wearer in the opening 21 of the shank 20 prevents the arm 71 of the module 70 from being removed from the bore 31 of the setting 30. Consequently, the setting 30 is prevented from escaping the mounting area 24 from any direction. In addition, most of the setting 30 is visible on the shank 20, which can enhance the aesthetic value of the jewelry article 16.

The foregoing description of preferred and other embodiments is not intended to limit or restrict the scope or applicability of the inventive concepts conceived of by the Applicants. In exchange for disclosing the inventive concepts contained herein, the Applicants desires all patent rights afforded by the appended claims. Therefore, it is intended that the invention include all modifications and alterations to the full extent that they come within the scope of the following claims or the equivalents thereof.

What is claimed is:

1. A jewelry article worn by a wearer, comprising:

an interchangeable setting;

a body defining a mounting area, the mounting area holding the setting on the body except substantially along one axis when at least a portion of the setting is positioned in the area; and a module discrete from the setting, said module slidably coupling on the body from a direction other than along the one axis and preventing removal of the setting from the mounting area substantially along the one axis and wherein said module has at least two sides that define a capture area, wherein the body defines a recessed portion that includes a bridge positioned between the mounting area and an opening for wearing the article, and wherein a portion of the module fits onto the bridge from the opening for wearing the article.

2. The jewelry article of claim 1, wherein the body has first and second sides and wherein the mounting area is defined through the body from the first side to the second side.

3. The jewelry article of claim 2, wherein portions of the body forming the mounting area to hold the setting are positioned along the two axes substantially orthogonal to the one axis.

4. The jewelry article of claim 3, wherein the mounting area is at least partially open along one of the substantially orthogonal axes to the one axis.

5. The jewelry article of claim 4, wherein the mounting area is defined by a radius and has a circumferential dimension at least greater than half of a circle.

6. The jewelry article of claim 5, wherein the at least a portion of setting includes a portion of a sphere, disk, or cylinder.

7. The jewelry article of claim 1, wherein the module defines a slot coupling with a portion of the body.

8. The jewelry article of claim 1, wherein the module is removable from the body such that the module is interchangeable.

9. The jewelry article of claim 1, wherein the module is fixedly and movably coupled to the body.

10. The jewelry article of claim 9, further comprising a biasing member biasing the module to capture the interchangeable setting.

11. The jewelry article of claim 1, wherein the module has at least one portion positioning at least partially adjacent the setting to prevent removal of the setting from the mounting area substantially along the one axis.

12. The jewelry article of claim 1, wherein the module has at least two portions positioning at least partially adjacent at least two portions of the setting to prevent removal of the setting from the mounting area substantially along the one axis.

13. The jewelry article of claim 12, wherein the at least two portions of the module include sides of the module positioning at least partially adjacent the at least two portions of the setting in the mounting area.

14. The jewelry article of claim 1, wherein the module remains mechanically coupled on the body by the wearer when the jewelry article is worn.

15. A jewelry article for a wearer, comprising:

an interchangeable setting;

means for holding the setting except substantially in both directions along one axis;

means discrete from the setting for preventing removal of the setting substantially along the one axis; and means for slidably coupling together the means for holding the setting and the means for preventing removal of the setting such that the interchangeable setting is substantially captured on the jewelry article, wherein said slidable coupling comprises sliding movement in a direction underneath the setting and other than along the one axis.

16. The jewelry article of claim 15, wherein the means for slidably coupling includes means for interchangeably fitting a first portion of the preventing means onto a second portion of the holding means.

17. The jewelry article of claim 15, wherein the means for slidably coupling includes means for fixedly and movably coupling the holding means to the preventing means.

18. The jewelry article of claim 16, wherein the means for fixedly and movably coupling further includes means for biasing the preventing means into engagement with the holding means.

19. The jewelry article of claim 15, further comprising means for maintaining the preventing means and the holding means mechanically coupled together by the wearer when the jewelry article is worn.

20. A jewelry article worn by a wearer, comprising:

an interchangeable setting;

a body defining a mounting area, the mounting area holding the setting on the body except substantially along one axis when at least a portion of the setting is positioned in the area;

a module discrete from the setting, said module slidably coupling on the body from a direction other than along the one axis and preventing removal of the setting from the mounting area substantially along the one axis, wherein the module defines a slot coupling with a portion of the body; and wherein the portion of the body includes a bridge of the body positioned between the mounting area and an opening for wearing the article, and wherein the slot of the module fits onto the bridge from the opening for wearing the article.

21. A jewelry article worn by a wearer, comprising:

an interchangeable setting;

a body defining a mounting area, the mounting area holding the setting on the body except substantially along one axis when at least a portion of the setting is positioned in the area; and a module discrete from the setting, said module slidably coupling on the body from a direction other than along the one axis and preventing removal of the setting from the mounting area substantially along the one axis, wherein the module magnetically couples to the body by one or more magnets in addition to mechanically coupling to the body.

22. A jewelry article for a wearer, comprising:

an interchangeable setting;

means for holding the setting except substantially along one axis;

means discrete from the setting for preventing removal of the setting substantially along the one axis; and means for slidably coupling together the means for holding the setting and the means for preventing removal of the setting such that the interchangeable setting is substantially captured on the jewelry article, wherein said slidable coupling comprises sliding movement in a direction other than along the one axis and wherein the means for slidably coupling further includes means for magnetically coupling the holding means to the preventing means.

23. A jewelry article for an interchangeable setting, comprising:

a body defining a mounting area, the mounting area holding the setting except substantially along one axis when at least a portion of the setting is positioned in the area; and a module discrete from the setting, said module slidably coupling on the body from underneath the setting in a direction other than along the one axis and holding the setting in the mounting area substantially along the one axis, wherein the module includes an arm inserting into a bore in the setting.

24. A jewelry article worn by a wearer, comprising:

an interchangeable setting;

a body defining a mounting area, the mounting area holding the setting on the body except substantially along one axis when at least a portion of the setting is positioned in the area; and a module discrete from the setting, said module slidably coupling on the body from a direction other than along the one axis and preventing removal of the setting from the mounting area substantially along the one axis and wherein the module includes an arm inserting into a bore in the interchangeable setting, wherein the body defines a recessed portion that includes a bridge positioned between the mounting area and an opening for wearing the article, and wherein a portion of the module fits onto the bridge from the opening for wearing the article.

* * * * *